United States Patent [19]

Kopp

[11] 4,055,668

[45] Oct. 25, 1977

[54] INFUSION PACKAGE

[75] Inventor: Georg Kopp, Neuhausen am Rheinfall, Switzerland

[73] Assignee: S I G Schweizerische Industrie-Gesellschaft, Neuhausen am Rheinfall, Switzerland

[21] Appl. No.: 668,077

[22] Filed: Mar. 18, 1976

[30] Foreign Application Priority Data

Mar. 25, 1975 Switzerland ..... 3814/75

[51] Int. Cl.[2] ..... B65B 29/04

[52] U.S. Cl. ..... 426/79; 206/.5; 426/83; 426/394

[58] Field of Search ..... 426/77–84, 426/394; 206/.5

[56] References Cited

U.S. PATENT DOCUMENTS

| | | | |
|---|---|---|---|
| 1,723,702 | 8/1929 | Mitchell | 206/.5 |
| 2,468,464 | 4/1949 | Salfisberg | 206/.5 |
| 2,791,505 | 5/1957 | Barnett | 206/.5 |
| 2,922,717 | 1/1960 | Whelan | 426/79 |
| 2,954,294 | 9/1960 | Whelan | 426/79 |
| 3,053,665 | 9/1962 | Irmscher | 426/394 X |
| 3,175,911 | 3/1965 | Rambold | 426/83 |
| 3,223,229 | 12/1965 | Welin-Berger | 426/79 |

FOREIGN PATENT DOCUMENTS

| | | | |
|---|---|---|---|
| 881,784 | 11/1961 | United Kingdom | 206/.5 |
| 817,302 | 7/1959 | United Kingdom | 426/83 |

*Primary Examiner*—Steven L. Weinstein
*Attorney, Agent, or Firm*—Spencer & Kaye

[57] ABSTRACT

A dosage pack includes a first and a second permeable bag joined to one another along a common seam and being arranged in a face-to-face relationship by folding the bags onto one another along a fold line extending in the common seam. A holder string positioned between the two bags has a first end attached to one of the bags and a second end attached to a tag positioned externally of the two bags.

4 Claims, 14 Drawing Figures

INFUSION PACKAGE

BACKGROUND OF THE INVENTION

This invention relates to a dosage pack (infusion package) such as a tea bag which is provided with a holder string and which is made of permeable material and may be mass produced in a simple manner without using staples and thus avoiding the disadvantages inherent in metal parts.

A known dosage pack of the above-outlined type comprises two bags which are connected to one another by a common transversal seam and about which the two bags are folded to be arranged in a face-to-face relationship. The two bags are, at least at one free edge zone, attached to one another by welding, knurling or gluing and further, the holder string is arranged between the two bags; the ends of the holder strings are attached to the bag material. Such a dosage pack may be made without using staples or any other metal components.

In use, a bag portion which is connected with one end of the holder string and which is constituted, for example, by a double strip connected to the face-to-face arranged bags with weakened lines, has to be separated from the bags and pulled to expose the holder string. Thereafter, the double strip, attached to the holder string, is hung on the outside of a cup or glass, while the contents of the pack are dissolved.

It has been found that when the double strip or the like is torn off, sometimes one or both bags are ripped open so that their contents spill into the liquid instead of being only dissolved therein. Further, the use of a tear strip is inconvenient in itself.

SUMMARY OF THE INVENTION

It is an object of the invention to provide an improved dosage pack of the above-outlined type from which the discussed disadvantages are eliminated.

This object and others to become apparent as the specification progresses, are accomplished by the invention, according to which, briefly stated, one end of the holder string is connected not to the bag material itself, but to a tag which lies on the outside of the face-to-face arranged bags.

In order to expose the holder string it is merely required to pull on the tag. This arrangement not only facilitates the handling of the dosage pack, but also simplifies its manufacture.

DESCRIPTION OF THE PREFERRED EMBODIMENT

Figure 1:
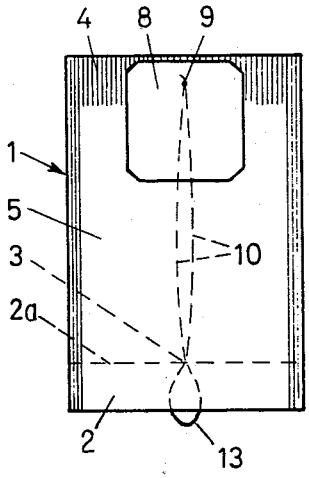
FIG. 1 is a front elevational view of a preferred embodiment of the invention.
Figure 2:
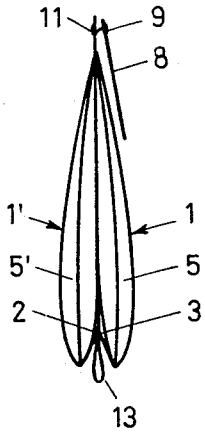
FIG. 2 is a side elevational view of the same embodiment.
Figure 3:
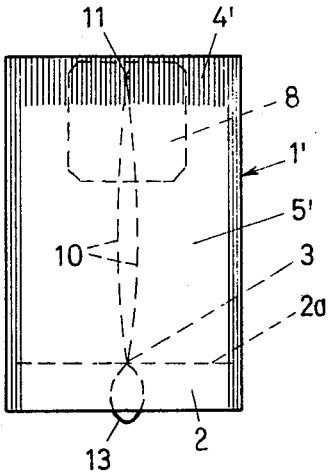
FIG. 3 is a rear elevational view of the same embodiment.

Turning now to FIGS. 1, 2 and 3, the dosage pack (infusion package) shown therein has two bags 1 and 1' which are made from a hose of permeable sheet material such as filter paper. The bags 1 and 1' are interconnected by means of a common transverse seam 2 which includes a fold line *2a* about which the two bags 1 and 1' are folded to assume a face-to-face relationship. The fold line has, in the middle, a small opening 3. Two free transverse seams 4 and 4' close off, at the top, two bag chambers 5 and 5', each filled with one-half of the dosage, such as tea. The bag chambers 5 and 5' are laterally bounded by longitudinal seams 6 and 6' made during the manufacture of the hose. The seams 2, 4, 6 and 4', 6' which may be obtained by welding, knurling or gluing, are indicated with shade lines in the Figures.

One end 9 of a holder string 10 is bonded, for example welded or glued, to a tag 8. The other end 11 of the holder string 10 is attached to the transverse seam 4'. The holder string 10 is threaded twice through the opening 3 so that at the lower side thereof there is formed a small loop 13. The completed dosage pack is obtained from the FIG. 4 and FIG. 5 arrangements by folding the transverse seam 2 in the middle along the fold line *2a* and connecting the now superposed (face-to-face arranged) outer seams 4 and 4', for example, by a glue or weld spot. Thus, the transverse seam 2 is divided, by the fold line *2a,* into two longitudinal halves which assume a face-to-face relationship as the two bags 1, 1' are folded to one another about the fold line *2a.* As may be seen in FIGS. 1, 2 and 3, expediently the seam halves of the transverse seam 2 are folded inwardly between the two bags 1, 1'. In this manner a substantial portion of the loop 13 is sandwiched between the seam halves.

Expediently, holder strings made of polypropylene are used. By applying heat and pressure, holder strings made of this material may be easily and reliably attached to the bag material and the tag. In order to ensure a bond of high resistance, a sufficient amount of weldable material must be available. By forming a small string loop 13, as described above, this condition is met even when a normal, thin string is used.

Figure 6:
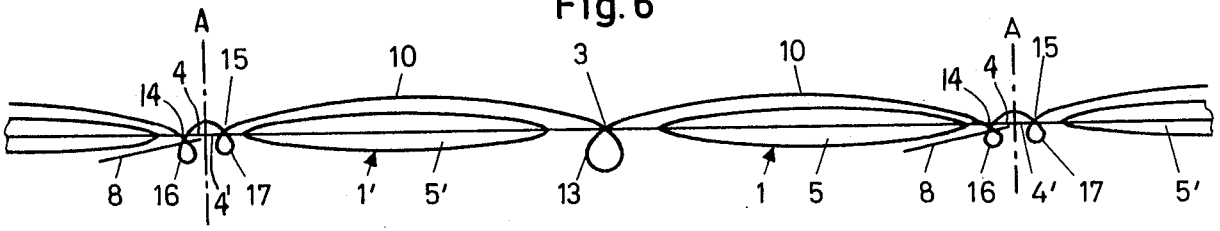
FIG. 6 is a side elevational view of a bag series depicted in a manufacturing phase of the dosage packs structured according to the invention.
Figure 7:
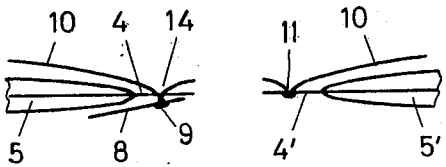
FIG. 7 illustrates a portion of the bag series according to FIG. 6, subsequent to severing.
Figure 8:
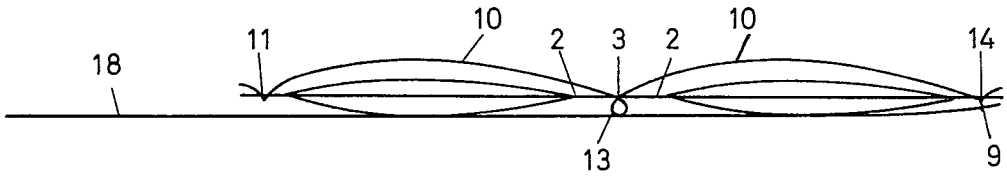
FIG. 8 is a side elevational view of another preferred embodiment, illustrating two interconnected bags in an open position.
Figure 9:
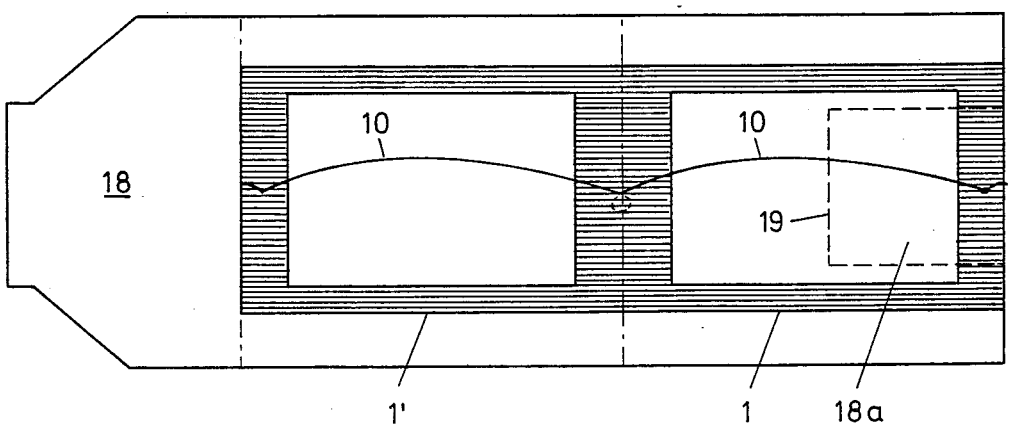
FIG. 9 is a top plan view of the arrangement shown in FIG. 8.

In the description that follows, the manufacture of the dosage packs will be set forth, with particular reference to FIGS. 6 and 7.

First, a continuous bag series is formed from a hose. The bag series has continuous, oppositely located, longitudinal seams 6,6' and spaced transverse seams 2.

The holder string is continuously applied to the bag series, for example, by a special sewing machine. As seen in FIG. 6, in the seam 4,4' adjacent holes 14 and 15 are formed through which the holder string is passed twice to form respective loops 16 and 17. The loop 16 also passes through the tag 8 positioned under the seam 4. In the seam 2, the string loop 13 is formed, as described above.

Each string loop 16 is bonded to its respective tag 8 and, further, each string loop 17 passing through the hole 15 is bonded to the seam 4'. By virtue of the loops 16 and 17, there will always be a sufficient amount of material available for making very satisfactory bonds.

Subsequent to the bonding of the string to the bags (more particularly, to the bag seams 4') and to the tags 8, the bag series is severed into bag pairs along cutting lines A for transversely separating adjoining seam zones 4 and 4' from one another and further severing the string between each adjoining location 14 and 15.

FIG. 7 illustrates the severed end portions of two bag pairs. The end portion of the lefthand bag pair includes the seam 4 having the opening 14 (through which the string 10 may slide if the tag 8 is pulled) and the string end 9 bonded to the tag 8. The end portion of the right-hand bag pair includes the seam 4' and its now plugged opening 15 and the string end 11 bonded to the seam 4'.

If now, in the completed dosage pack (shown, for example, in FIG. 2), the tag 8 is pulled, the loop 13 will disappear as it is pulled out of the opening 3 in the seam 2. The holder string 10 will glide out full length through the opening 14 provided in the seam 4 and is ready for use.

The possibility of applying the holder string by means of a sewing machine means a significantly more economical manufacture of the dosage pack compared to known arrangements. Also, it is no longer necessary to provide a perforation or the like in order to be able to tear off a double strip attached with the terminus 9 of the holder string 10. A damaging of the bags 1 and 1' during the pulling of the holder string 10 disposed between the bags 1 and 1' is securely prevented.

Instead of the tag 8 shown, it is feasible to provide a rider tag, the legs of which lie on the outer sides of the two bags 1 and 1'.

Figure 4:
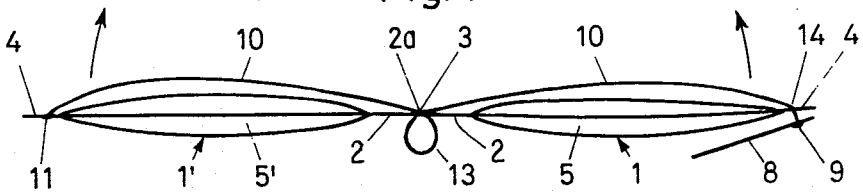
FIG. 4 is a side elevational view of two interconnected bags depicted in a manufacturing phase of the preferred embodiment.
Figure 5:
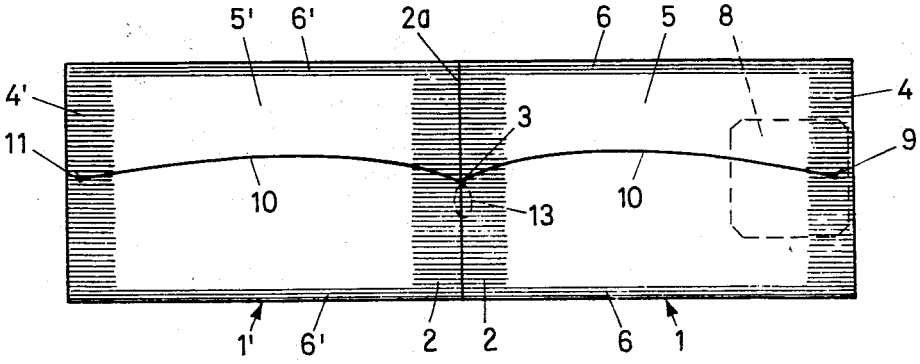
FIG. 5 is a top plan view of the arrangement shown in FIG. 4.
Figure 10:
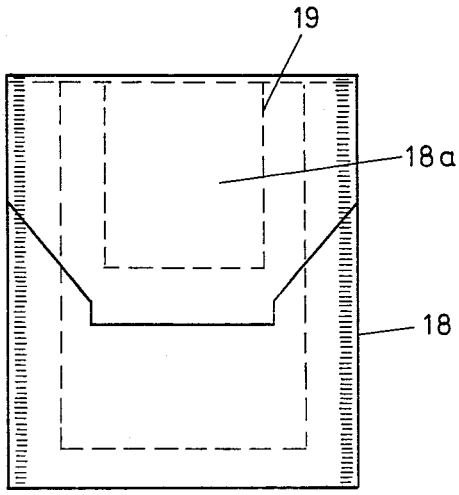
FIG. 10 is a front elevational view of the same embodiment, illustrated in a closed position.
Figure 11:
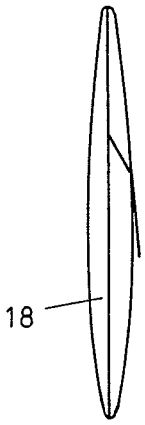
FIG. 11 is a side elevational view of the arrangement shown in FIG. 10.
Figure 12:
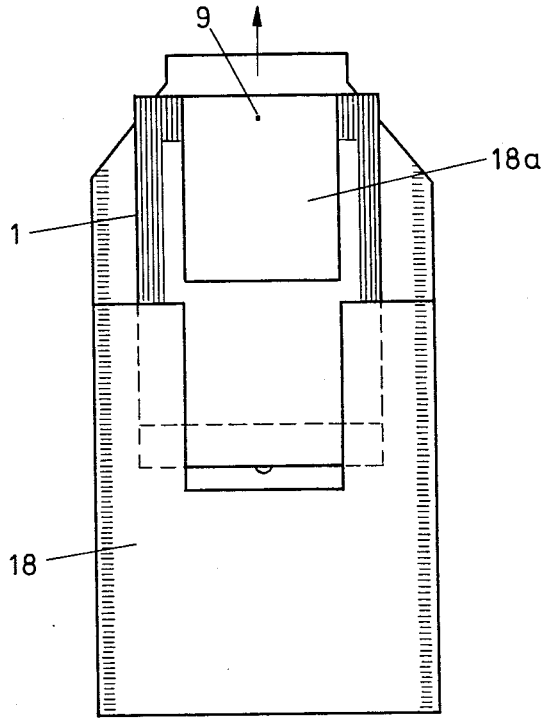
FIG. 12 is a view similar to FIG. 10 showing the removal of the dosage pack from its envelope.
Figure 14:
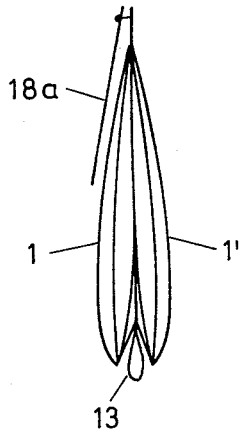
FIG. 14 is a side elevational view of the arrangement shown in FIG. 13.
Figure 13:
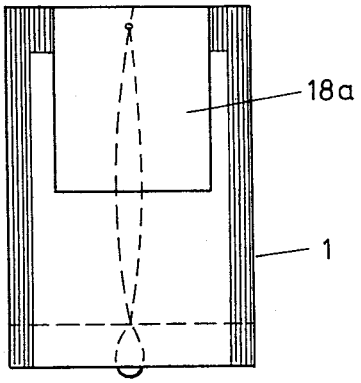
FIG. 13 is a front elevational view of the dosage pack removed from its envelope.

Occasionally, it is expedient to provide the dosage packs with protective sleeves, for example, in the form of a small envelope. If the dual bag illustrated in FIGS. 1–3 is placed in such an envelope, the tag 8 may be constituted by a separable portion of such an envelope. Such an embodiment is illustrated in FIGS. 8 to 14. As may be particularly well observed in FIGS. 8 and 9, which, similarly to the respective FIGS. 4 and 5, show the interconnected bags 1 and 1' in an open, spread-apart condition, an outer envelope 18 is placed on one side of the bags. A tag portion 18*a* forms an integral part of the envelope 18 and may be separated therefrom along lines 19. The tag portion 18*a* is attached to the string end 9 and thus replaces the separate tag 8 of the earlier-described embodiment. FIGS. 10 and 11 show the envelope 18 in a closed position, in front and side elevational views, respectively. Thus, to prepare the dosage pack for use, the envelope 18 is opened, the envelope portion 18*a* is separated from the remainder of the envelope 18 by tearing along lines 19 and the dosage pack is removed from the envelope 18 (FIG. 12). Thus, the separated portion 18*a* is, regarding its disposition with respect to the dosage pack, its configuration and function, equivalent to the tag 8 (FIGS. 13 and 14).

It will be understood that the above description of the present invention is susceptible to various modifications, changes and adaptations, and the same are intended to be comprehended within the meaning and range of equivalents of the appended claims.

What is claimed is:

1. An infusion package including a first and a second bag joined to one another along a common first seam and being arranged in a face-to-face relationship by folding the bags onto one another along a fold line extending in the first seam and dividing the first seam into face-to-face arranged longitudinal halves; each bag having a free edge opposite the first seam; a second seam extending along the free edge of the first bag; a third seam extending along the free edge of the second bag; the second and the third seam being in a face-to-face relationship and being secured to one another; and a holder string positioned between the two bags; the holder string having a first end attached to one of the bags and a second end attached to a tag; the improvement comprising means defining a first and a second opening in said first and said second seam, respectively; said first end of said holder string being affixed to said third seam; said holder string extending between said first and second bags looplessly to said first opening from its attachment to said third seam; said holder string being glidably threaded twice through said first opening to form a string loop oriented externally of said bags; said holder string further extending between said first and second bags looplessly to said second opening from said first opening; said holder string being glidably threaded, adjacent its said second end, through said second opening; said tag being arranged externally of said bags adjacent said second seam, such that pulling said tag away from said second seam causes said holder string to be pulled through said second opening and out of said first opening under the gradual disappearance of said string loop and holder string portions extending from said third seam to said first opening and from said first opening to said second opening.

2. An infusion package as defined in claim 1, further comprising an envelope accommodating said bags; said tag being formed as an integral, separable portion of said envelope.

3. An infusion package as defined in claim 1, wherein said holder string is made of polypropylene.

4. An infusion package as defined in claim 1, wherein said longitudinal halves of said first seam are folded inwardly between said two bags; at least a substantial portion of said string loop being arranged between said longitudinal halves of said first seam.

* * * * *